United States Patent [19]

Robillard

[11] 4,361,645

[45] Nov. 30, 1982

[54] COLOR PHOTOGRAPHY ELEMENT WITH INDUCED SPECTROSENSITIZATION

[76] Inventor: Jean J. Robillard, 46 Arnold Rd., Pelham, Mass. 01002

[21] Appl. No.: 231,268

[22] Filed: Feb. 3, 1981

[51] Int. Cl.[3] ..... G03C 1/76

[52] U.S. Cl. ..... 430/505; 430/349; 430/494; 430/550; 430/570; 430/591; 430/955; 354/28

[58] Field of Search ..... 430/345, 494, 550, 570, 430/591, 955, 962, 964, 335, 505, 349

[56] References Cited

U.S. PATENT DOCUMENTS 3,105,761 10/1963 Foris ..... 430/494
3,482,981 12/1969 Van Lare ..... 430/570
3,796,579 3/1974 Brooker et al. ..... 430/494
3,923,524 12/1975 Haase ..... 430/591

*Primary Examiner*—J. Travis Brown
*Attorney, Agent, or Firm*—Sherman & Shalloway

[57] ABSTRACT

A photographic element comprising a plurality of layers (e.g., three) of light sensitive emulsions arranged one on top of the other and based on a support, each of the emulsions comprising a coupler, a silver halide compound and a sensitization promoter which is transformed into a sensitizer by thermal, photo- or electro-sensitization. Novel processes of color photography and spectral sensitization of color photography emulsions are also disclosed. Furthermore, cameras having means to activate the sensitization promoters in the emulsions are provided.

16 Claims, 15 Drawing Figures

405
403
401
409
411
413
415
407

505
501
503
513
511
509
519
517
515
507

805
803
801
809
807

905
903
911
909
917
913
919
915
901
907

COLOR PHOTOGRAPHY ELEMENT WITH INDUCED SPECTROSENSITIZATION

BACKGROUND OF THE INVENTION

This invention relates to color photography. More particularly, this invention relates to color photography elements with induced spectral sensitization. This invention also relates to a novel process of forming a sensitizer useful in color photography. Furthermore, this invention relates to a novel color photography process.

The methods used in color photography are all based on the fact that the eye is essentially receptive to three basic colors: blue (between 400 and 500 millimicrons), green (between 500 and 600 millimicrons) and red (between 600 and 700 millimicrons). The subjective reproduction of a given color, i.e., a certain distribution of light energy, can be obtained by the reproduction of the same average value of energy density in these three bands.

Any color photographic process involves necessarily the two following steps:

(a) Analysis of the colors from the subject; and (b) Synthesis of the same colors. According to the mode of synthesis, one can distinguish between the additive and substractive processes. In addition systems the colors are formed by adding three fumdamental colors such as blue, green and red in the amount in the original subject. In subtractive systems the colors are formed by adding the complementary colors of the three fundamental colors blue, green and red found in the original subject. Looking at the image the eye then receives the complementary color of that existing on the print thereby restituting the original colors. The complementary colors of blue, green and red are respectively yellow, magenta and cyan.

The subtractive systems are practically the only ones still in use for photography. There are a number of color processes available to the industry today.

Color selection can take place in two different manners:

(a) with three filters and a single emulsion sensitive to a broad spectrum in the visible; and (b) with three emulsions sensitive to the three basic colors. In case (a) the filters can be incorporated into the emulsion in the form of a trichromic frame.

Color selection with three emulsions is the usual case. Each emulsion is sensitive to a basic color. A structure with three emulsions is represented in FIG. 1. The emulsions are generally separated by thin transparent layers with or without filter action.

Color synthesis can be obtained by selective generation of dyes, as it is usually the case, by modifying dyes already present in the emulsion, by selective discoloration or by selective masking.

The dyes formation involves a reaction between a developing agent and three complexing agents catalyzed by the presence of the photo-reduced silver in the emulsion. This reaction includes three different steps:

(a) Developer + n $Ag^+$ → n Ag + oxidized developer (b) Oxidized developer + Coupler → leuco dye (c) Leuco dye + Oxidizing agent → Dye Developers are paraphenylenediamine derivatives having the general formula:

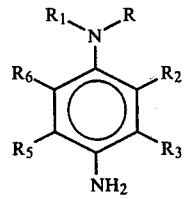

$R, R_1$ = alkyl, e.g., $CH_3$, $CH_2CH_3$ $R_2, R_3, R_5, R_6$ = alkyl and/or aryl which may be substituted or unsubstituted Two types of couplers can be utilized:

(a) Phenol or naphtol derivatives leading to cyan dyes belonging to the indoaniline group (b) Methylene derivatives having a methylene activated function and leading to yellow and magenta dyes of the azomethines group.

The reaction mechanism is as follows:

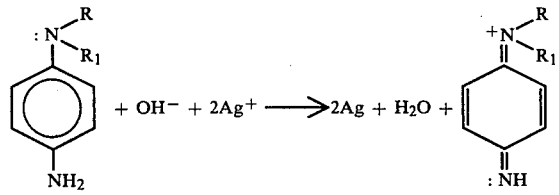

In basic pH the molecule of the developer is oxidized by the metal ion $Ag^+$ thereby giving a diimine quinone ion stabilized by resonance:

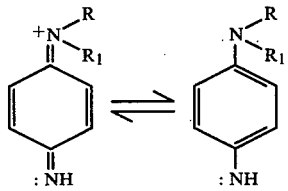

The following step is the reaction of the quinone diimine ion with the coupler ion. In basic pH, the coupler is strongly ionized:

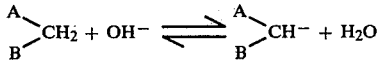

which allows for the coupling:

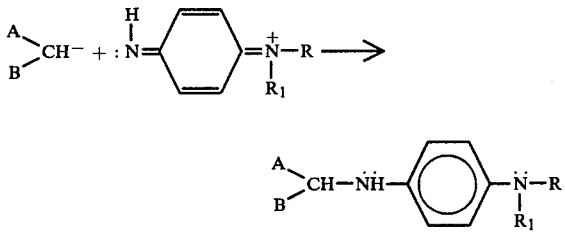

LEUCO DERIVATIVE

The leuco derivative is then oxidized to form the dye:

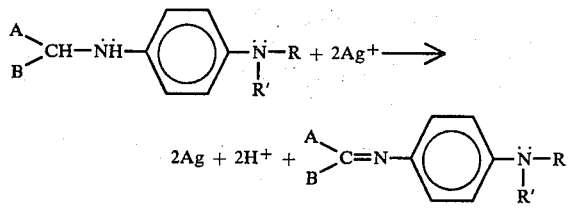

where A and B can be the same or different and are selected from the group consisting of $CH_3$, $C_2H_5$, $CH_3SO_2NHC_2H_4$, $C_2H_4OH$ and $C_6H_5$.

Emulsions with multiple layers provide color images by direct processing. The images can be negatives with complementary colors or positives after inversion. The structure is made of three superimposed emulsion layers separated by thin gelatin layers. These emulsions are, starting from the substrate or support:

1. a red sensitized emulsion
2. a green sensitized emulsion, and
3. an unsensitized emulsion which is naturally sensitized to the blue or a blue sensitized emulsion, depending on the silver halide used. The red sensitized emulsion is more sensitive than the green which is itself more sensitive than the blue, in order to compensate for the light absorbed in the preceeding layers.

The top emulsion layer receives light first and absorbs the blue forming a latent blue image. The red and green are transmitted through the first layer. The green is absorbed by the second layer which forms a green image and transmits the red which is finally absorbed by the third layer.

In order to avoid the transmission of the color corresponding to a sensitized layer to the next one, a dye is incorporated to that emulsion or to the separating layer. Such dyes are eliminated during the processing of the emulsion layers.

The thickness of each sensitive layer varies from 1 to 3 microns and the separating layers are 0.5 to 1 micron.

The peak sensitivities are:

UV to 450 nm for the blue, 530 nm for the green and 630 nm for the red.

Unfortunately it is not possible to avoid a general sensitivity to ultraviolet (UV) light.

The absorption spectrum of silver halides is in ultraviolet with some extension in the blue depending on the halide. Although silver iodide absorbs most in the blue (up to 560 nm), silver bromide does not. The sensitivity in the visible is brought about by the addition to the emulsions of various sensitizing dyes which promote absorption in a region of the spectrum very close to their own absorption band.

For color films the sensitizing dyes are chosen to match the fundamental colors: red, blue and green, for positive films; and yellow, magenta and cyan for negative films. The three dyes are formed during the processing and appear simultaneously together with the reduced silver.

Conventional color photographic emulsions are normally pre-sensitized for the regions of the spectrum corresponding to the colors to be photographed. Because the emulsions are pre-sensitized, photographic films and papers coated with such emulsions must be kept in the dark since exposure thereof will cause the absorption of light rays to form color images. Thus, as is commonly known, photographic films and papers must be handled with care and in the dark. Needless to say, such restriction in handling is highly inconvenient. One of the objectives of the present invention is directed to the elimination of such restriction in the handling of photographic films and papers.

With reference to spectral sensitization, the various energy levels which are necessary for understanding the mechanism of dye sensitization are diagrammed in FIG. 2. The values are given in electron-volts in relation to the zero reference energy level at $\infty$. In order to take into consideration the effect of macroscopic space charges, it is desirable to introduce the macropotential $V_M$. Every change of this potential brought about by any kind of changes—for example those charges produced by adsorption, and so on—brings about an analogous change of all levels. For the purpose of simplification this macropotential shall be zero in the present scheme. The following energy levels are to be considered:

(a) The Fermi level $E_F$ is below the zero level or exactly below the electrostatic macropotential. In intrinsic semiconductors and insulators this level lies between the valence band and the conduction band. For n-type semiconductors, the position is below the conduction band (FIG. 3) and for the p-type semiconductors the Fermi level is raised by light (quasi Fermi level), and in p-type semiconductors, a decrease of the Fermi level under illumination is observed. The depth of the Fermi levels are obtained from the measurement of the thermoelectric work function $\zeta$ in vacuum.

(b) Another energy value is the photoelectric work function $\zeta$ which can be obtained from the threshold wavelength for the external photoelectric effect. This function is identical to the ionization potential.

(c) The magnitude of the energy gap E between the valence band and the conduction band can be obtained from the onset of the absorption spectrum of the semiconductor or from the measurement of the optical threshold energy for photoconductivity.

(d) The energy of the bottom of the conduction band is identical with the electron affinity $\chi$. One can compute the electron affinity from the difference between the photoelectric work function $\zeta$ and the energy gap E: $\chi=\zeta-E$.

Additional information on a dye may be obtained from the oxidation—reduction potentials which are a measure of the energy which is required to make an electron pass from the electrode to the lowest unoccupied level of the dye molecule. In general, the first excited electronic state of many organic molecules is situated 3 to 4 eV below the vacuum level.

Table I shows the values of the energy levels of various dyes with respect to those of AgBr and solid dyes. The diagram in FIG. 5 exhibits this relative position of the electronic energy levels in AgBr and dye molecules.

It is seen that the excited singlet level (or the conduction band) of dye molecules must be located above the conduction band of AgBr. The relative heights of the Fermi levels ar significant for the electron exchange between semiconductors.

Two mechanisms are generally accepted for the spectral sensitization in semiconductors: energy transfer and electron transfer mechanisms (see FIGS. *6a, 6b, 6c* and *6d*).

In the energy transfer mechanism, the excitation energy of the sensitizing dye molecule is transferred to the intermediate and surface levels of the AgBr that are occupied by electrons. In the case of an n-type semiconductor these electrons can be raised to the conduction band of AgBr and bring about n-type sensitized photoconductivity.

According to the electron transfer mechanism the excited dye molecule gives up its electron to the semiconductor. In this case the electron transferred by the dye must be replaced by an electron from donor levels in AgBr. The electron transfer mechanism can be divided in two steps:

(a) the appearance of a free electron in the excited level of the dye which may be able to travel through a close packed layer of molecules of dyes and the transition of the excited electron, the energy of which must be greater than that in the conductive state of the solid, to the semiconductor.

| MATERIAL | Type | (eV) | (eV) | X (eV) | E (eV) | Contact Potential (mV) |
|---|---|---|---|---|---|---|
| AgBr | p | 5.33 | 6.00 | 3.5 | 2.5 | Pd − 380 |
| Rhodamine B | n | 4.45 | 5.2 | 3.2 | 2.0 | Pd + 500 |
| Erythrosin | p | 4.64 | 5.5 | 3.3 | 2.2 | Pd + 310 |
| Malachite green | n | 4.84 | | | 2.0 | Pd + 90 |
| Pinacyanol | n | 4.55 | 4.9 | 3.1 | 1.8 | Pd + 400 |
| Crystal violet | n | 3.32 | 5.1 | 3.0 | 1.7 | CdS + 180 |
| Phthalocyanine | p | | 6.0 | 4.3 | 1.7 | |
| Phenosafranine | | 5.0 | 5.4 | 3.3 | 2.1 | |
| Methylene blue | p | 5.2 | 5.4 | 3.6 | 1.8 | |
| Merocyanine 1 | p | | 5.8 | 3.5 | 2.3 | |

(b) the recombination of the hole in the emptied ground level of the dye from the semiconductor.

In both mechanisms the relative position of the energy bands in the dye and AgBr is of importance and will determine the compatibility of a specific dye for sensitization.

SUMMARY OF THE INVENTION

The present invention provides a color photography element wherein the sensitizers are activated prior to exposure by the application of an activation energy. The absence of sensitizers in the emulsions of the photographic element alleviates much of the restrictions placed on the handling of the photographic element. Since the element is not sensitized, it can be exposed to low level of light, e.g., room light, without causing the formation of color images. To use the photographic element, the promoter material provided in the element is converted to a sensitizer by the application of an activation energy. Examples of activation energy include the thermal energy, photo-energy and electro-energy.

The present invention also provides a novel color photography process which comprises activating a photographic element having a promoter material which can be converted into a sensitizer by the application of an activation energy; exposing the so-activated element; and developing the exposed element.

The present invention further provides a camera which can be used in conjunction with the color photography element. The camera of this invention is provided with means for activating the photography element using thermal, photo or electro energy.

FIGS. *6a, 6b, 6c* and *6d* exhibit the mechanisms for spectral sensitization in semiconductors.

Figure 7:
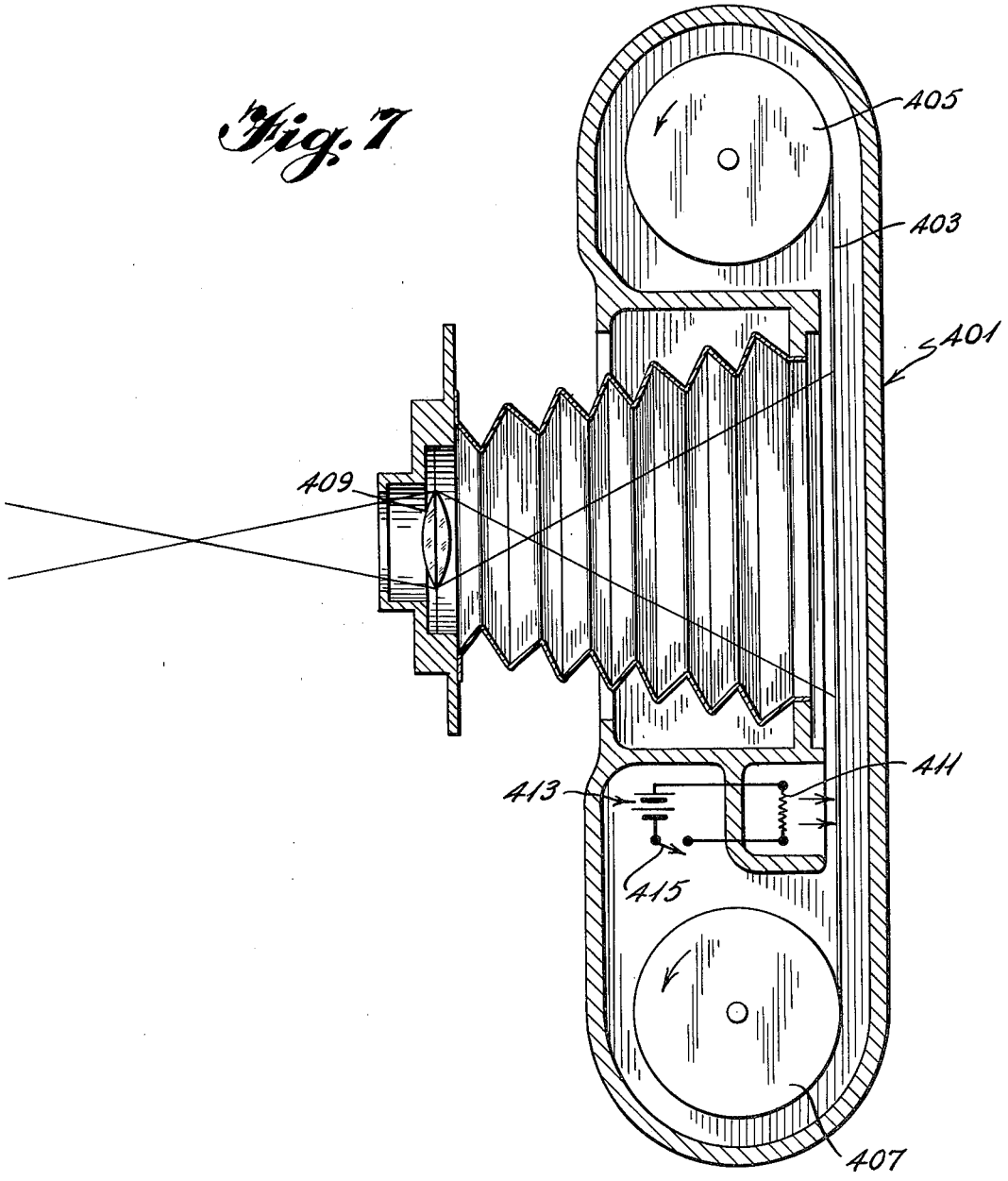
Figure 8:
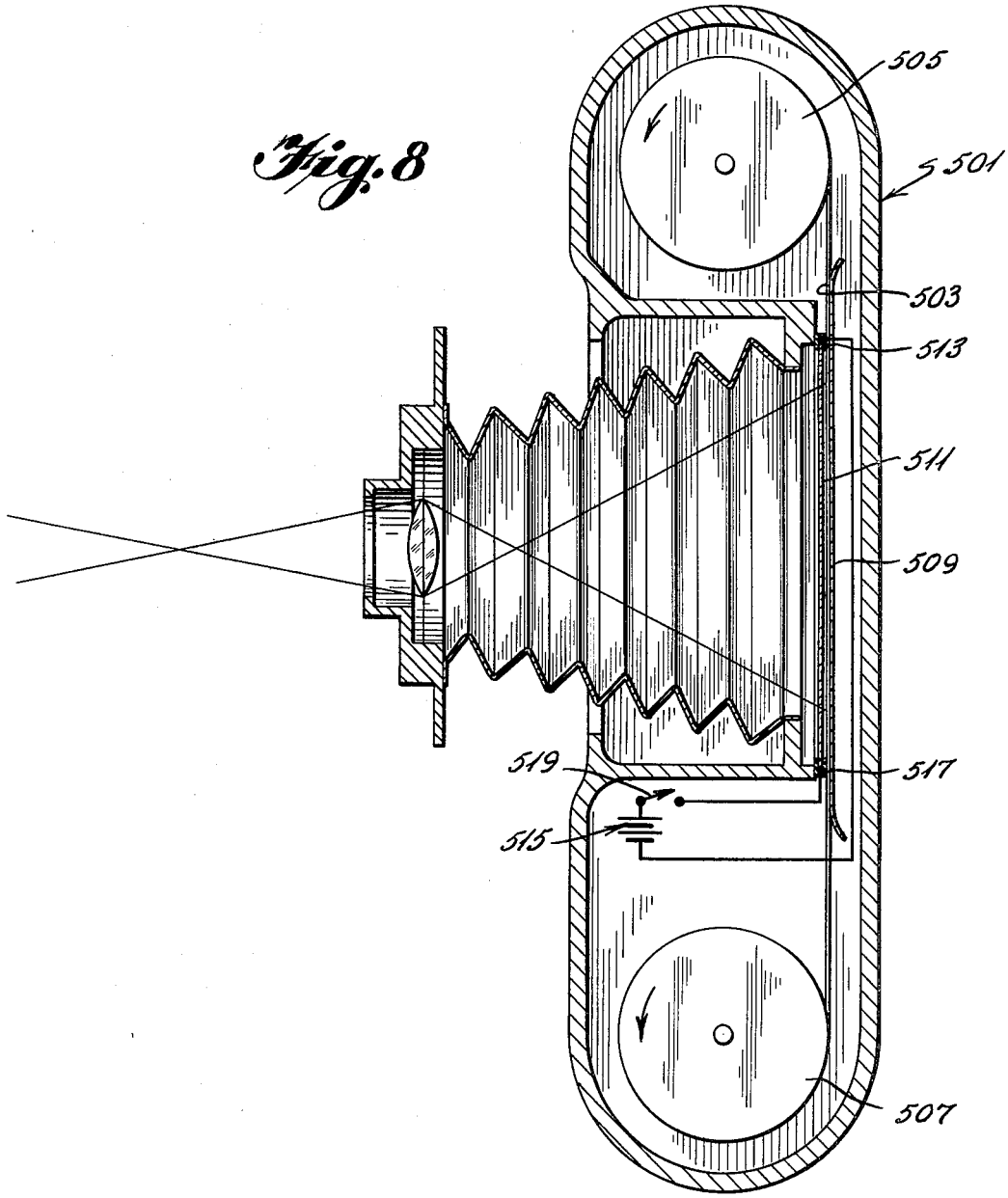

FIGS. 7 and 8 show cameras equipped with thermal activation means in accordance with the present invention.

Figure 9:
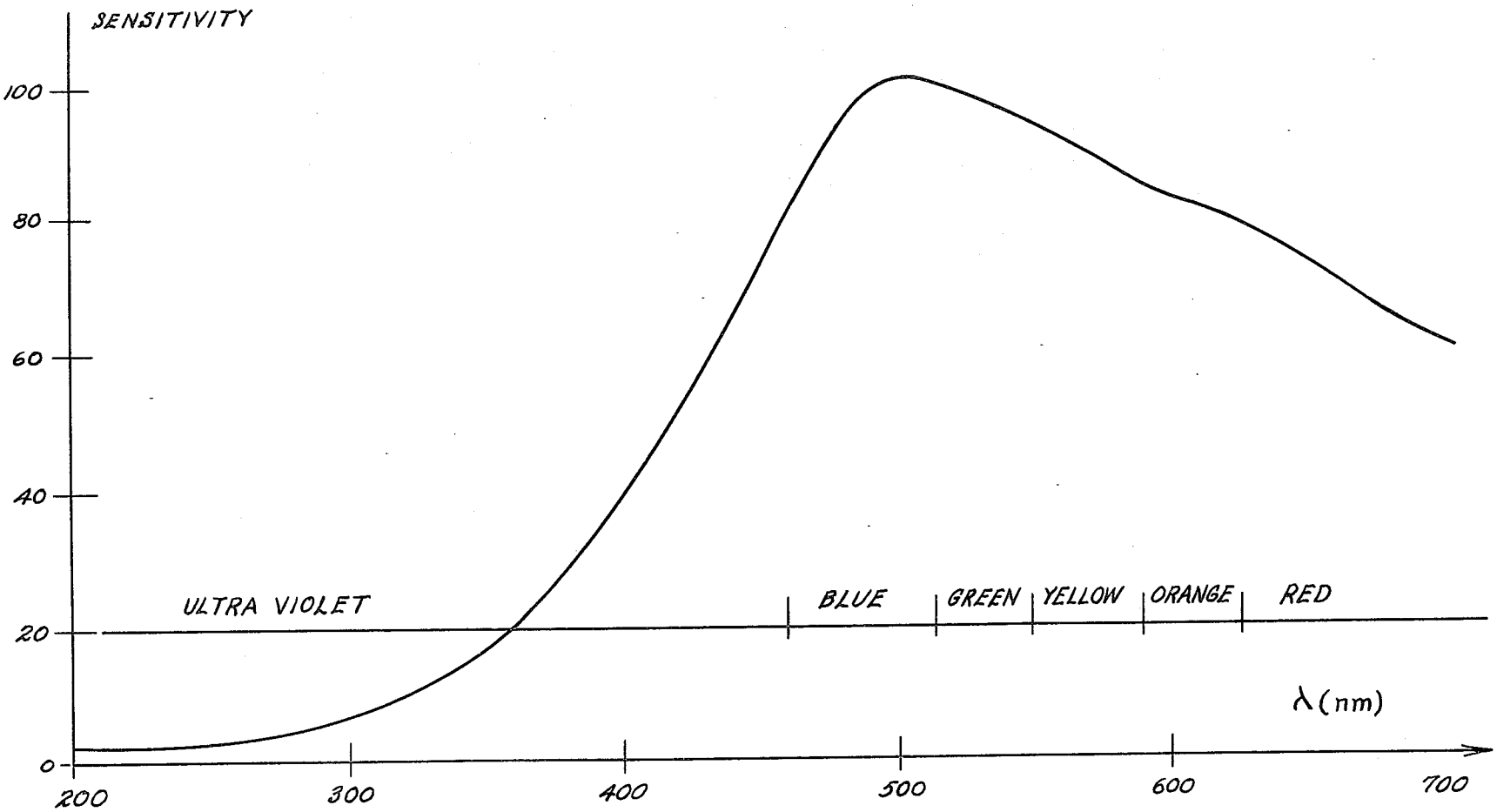

FIG. 9 shows the emission spectrum of sunlight.

Figure 10:
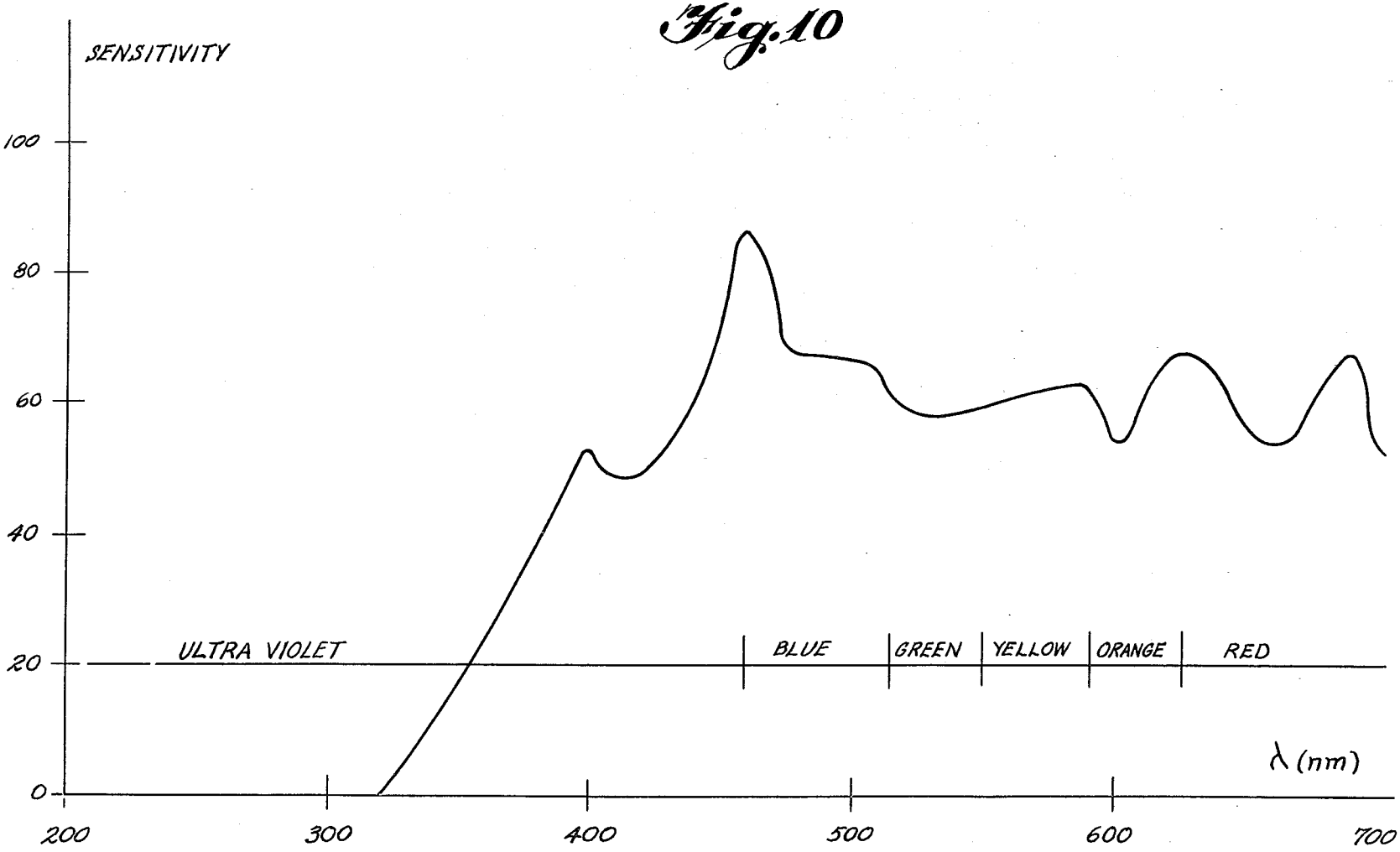

FIG. 10 shows the emission spectrum of a Xenon Lamp.

Figure 11:
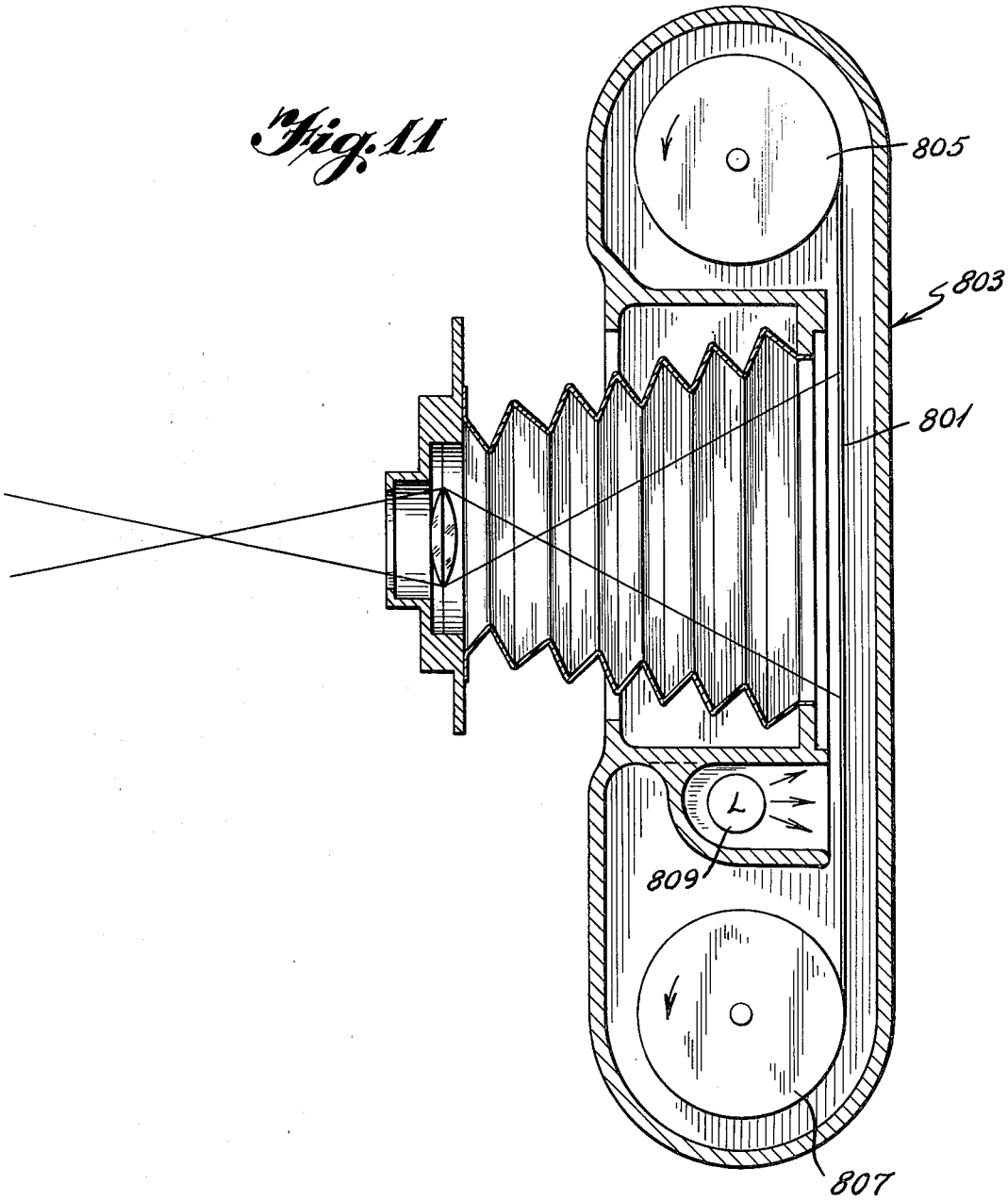
Figure 12:
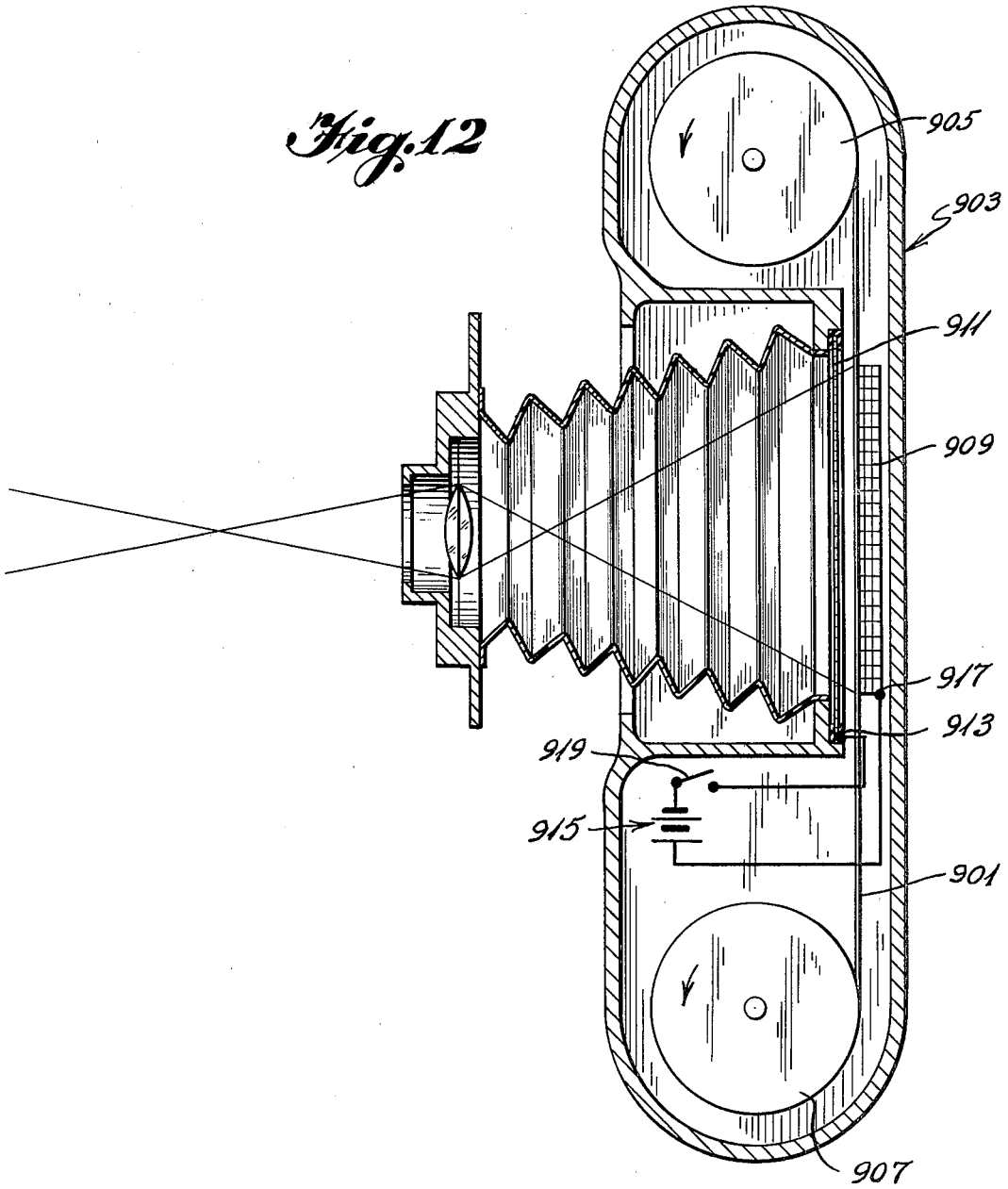

FIGS. 11 and 12 illustrate cameras equipped with photo- and electro-activation means, respectively, in accordance with the present invention.

DETAILED DESCRIPTION OF THE INVENTION

The present invention is based on the discovery that certain compounds can be converted to sensitizers useful in color photography by the application of an activation energy. That is to say, unlike conventional color photography elements which are permanently sensitized, the color photography element of the present invention is provided with a sensitization promoter compound which can be converted to a sensitizer before use. Since the photographic elements of the present invention are sensitized only prior to use, the handling thereof is much simpler and less restricted. As a result of the absence of a sensitizer therein, the present photographic element can be exposed to low to moderate level light, e.g., room light, without the formation of color images which constitutes a major advantage of the present invention.

In addition, in the present invention, the sensitizers in the emulsions are freshly formed as a result of the in situ activation prior to exposure. Thus, the possibility of stale emulsions from prolonged storage is lessened substantially.

According to the present invention, a photographic element comprising a support and a plurality of emulsion layers arranged one on top of the other is provided. In each emulsion layer there is provided a silver halide, such as silver bromide, silver iodide and silver bromoiodide, a sensitization promoter and a coupling agent. The sensitization promoter does not sensitize the emulsion by itself but can produce a sensitizer in situ upon proper activation:

$$\text{PROMOTER} \xrightarrow{\text{Activation}} \text{SENSITIZER}$$

The activation can take place by three different stimulations:

a. Heat
b. Light
c. Electric field

This activation can be permanent or temporary. In the first case, it can be exerted any time prior to exposure in a dark room or in the camera itself. In the second case, it can be performed at the time of exposure in the camera. This second alternative introduces additional advantages such as replacing the shutter by a control of the activation time which is particularly appropriate for pulsed light or electrical activation. Furthermore, since the sensitization effect is only temporary, the promoter material reverts to its original form after the elapse of time. Hence, the photographic element can be reactivated if necessary.

The three following schemes are applicable in the present invention:

$$\text{PROMOTER} \xrightarrow{\text{Heat (T)}} \text{SENSITIZER} \quad (1)$$

$$\text{PROMOTER} \xrightarrow{\text{Light } (\phi)} \text{SENSITIZER} \quad (2)$$

$$\text{PROMOTER} \xrightarrow[\text{Field (E)}]{\text{Electrical}} \text{SENSITIZER} \quad (3)$$

Sensitizers can be promoted in a thermoactivated emulsion by raising the temperature to a specific value which is the sensitization threshold. The activation temperature should not have any direct effect on the unsensitized emulsion except for the promotion of the sensitizer.

The activation can be temporary or permanent. In temporary activation the duration of this activation should be sufficient to cover the exposure time. The process can also be initiated simultaneously with the exposure and controlled by a mechanical shutter.

The increase in temperature of the emulsion can be produced by conduction, radiant or induced heat. In conduction heating, the emulsion or its support is in contact with a hot surface generally heated by joule effect. The heater can be opaque and placed in contact with the back of the emulsion. A preferred method comprises the use of a transparent conductive glass (NESA*) in direct contact with the front of the emulsion. Electrodes on two borders of the glass plate allow an electric current to heat the glass on the surface until the proper temperature is reached.

*Product of Boeing Aircraft

In radiant heating the emulsion is placed in front of a hot body which radiates heat toward the emulsion. Usually, the hot body comprises a hot plate or an infrared lamp.

In induction heating the emulsion is placed in a radiofrequency field providing dielectric heating of the components of the emulsion. This mode of heating is the most controllable but also the most cumbersome except for industrial systems.

Materials able to provide a permanent sensitizer upon thermal activation are found in certain categories of thermochromes. A thermochrome is a material normally white or transparent which becomes colored by an increase in temperature. Being a thermochrome is not sufficient to provide a thermally activated spectral sensitization of silver halide. It is also necessary that the colored species are able to satisfy the energy requirements in macro-potential levels related to sensitizing mechanisms discussed above.

Examples of suitable thermochromes are the benzothiazol spiropyrans, having the general formula:

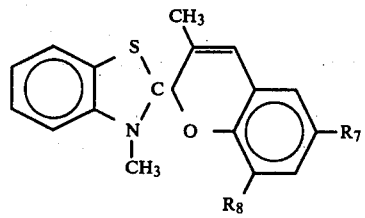

where $R_7$ and $R_8$ are halogens, for example Cl, Br;

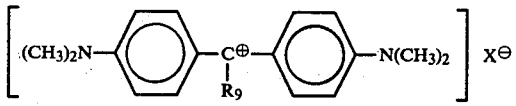

where $X^{\ominus}$ is an anion such as Cl and $R_9$ can be chosen among the following radicals:

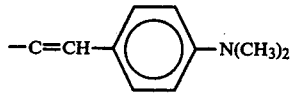

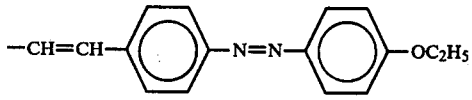

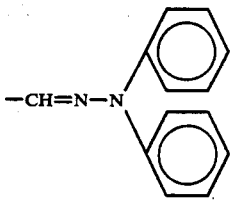

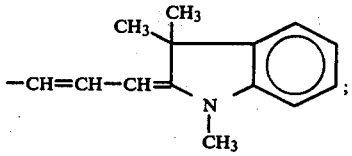

and pyrylium oxides such as diphenyl 1,3 benzopyrylium 2 oxide 4:

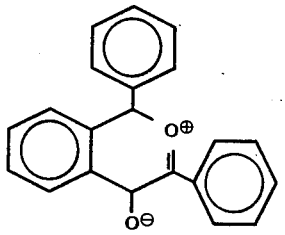

In temporary thermoactivation for photographic film, the heat source is disposed within the camera and the activation takes place just before or during exposure thereof. FIGS. 7 and 8 show two alternatives of camera constructions according to the present invention.

As shown in FIG. 7, the camera comprises a camera body, 401, in which photographic film 403 is stored.

Film 403 which is in the form of a strip has one end wound onto take-up spool 405 after exposure and the other end wound on supply spool 407. Prior to being aligned behind the lens 409 for exposure, the film is sensitized by subjecting the emulsions on the film to heat supplied by infrared heating element 411. The heating element is powered by battery 413 and activated by switch 415. To sensitize the film, switch 415 is activated, thus closing the circuit and heat is generated by the heating element 411. The duration and temperature to which the film is heated vary in accordance with the material used as the sensitization promoter material. After sensitization, the film is exposed by opening the shutter (not shown) whereupon an image is recorded on the film. The so-exposed film is then subjected to a conventional developing process to form a color photograph film which is in either a positive or negative form.

In another embodiment, the emulsions are thermally activated as shown in FIG. 8 wherein the film is heated by a heating plate. In FIG. 8, the camera comprises a body 501 in which a photorgraphy film 503 is disposed. One end of the film is wound on take-up spool 505, the other on supply spool 507. A portion of the film is interposed between back plate 509 and heating plate 511 which is formed of glass. The upper end 513 of plate 511 is connected to one of the terminals of a battery 515 whereas the other end (lower end) 517 is connected to a switch 519 which is in turn connected in series to the other terminal of the battery. Prior to exposure, the film is activated by closing switch 519 to heat the film for an appropriate period of time. As mentioned above, the duration and temperature to which the film is heated vary according to the material used as the sensitization promoter. After sensitization, the film is imagewise exposed and developed, as described above.

Sensitization promoters which can be temporarily activated by heat are in the class of thermochromic dyes and thermochromic reactions. The following compounds have been found to be particularly useful:

A. Red Sensitizers

The following compounds turn blue upon heating and therefore sensitize in the red part of the spectrum.

a. di-$\beta$-naphtospiropyran, SRa:

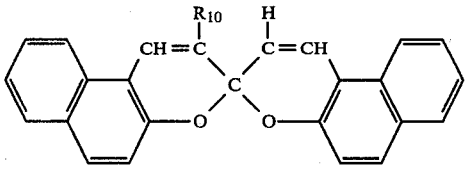

where $R_{10}$ is $CH_3$ or H b. xantho-$\beta$-naphtospiropyran, SRb:

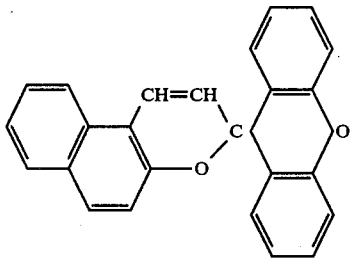

B. Green Sensitizers

The action of temperature on the following compounds develops a red coloration and promotes sensitization in the green:

a. Phenylene-di-benzospiropyran, SGa:

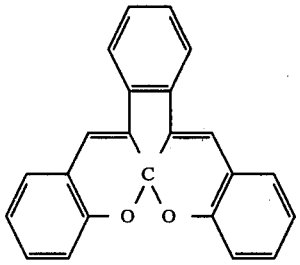

b. dimethyl 2,6$\gamma$ pyrylium oxide, SGb:

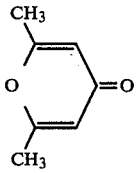

C. Blue Sensitizers

Thermally induced sensitization in the blue is provided by 3,3′ trimethylene-di-$\beta$ naphtospiropyran, SBa:

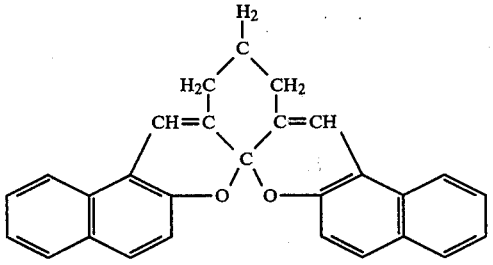

The composition of the sensitization promoter solutions to be introduced in the basic emulsions is varied, depending on the material used. The sensitization promotor material can be dissolved in a solvent and added to the emulsion to be sensitized. In general, the following proportions for the above-listed promoters and solvents can be used.

| | | |
|---|---|---|
| Red sensitizer, SRa: | | |
| di-$\beta$-naphtospiropyran | | 0.40 parts by wt. |
| anisole | | 100 parts by wt. |
| threshold activation temperature | 82 ° C. | |
| Red sensitizer, SRb: | | |
| Xantho-$\beta$-naphtospiropyran | | 0.30 parts by wt. |
| anisole | | 100 parts by wt. |
| threshold activation temperature | 60° C. | |
| Green sensitizer, SGa: | | |
| Phenylene-di-benzospiropyran | | 0.70 parts by wt. |
| anisole | | 100 parts by wt. |
| threshold activation temperature | 62° C. | |
| Green sensitizer, SGb: | | |

-continued

| | | |
|---|---|---|
| Dimethyl 2,6-γpyrylium oxide | | 0.80 parts by wt. |
| Ethyl alcohol | | 100 parts by wt. |
| threshold activation temperature | 48° C. | |
| Blue sensitizer, SBa: | | |
| 3,3'trimethylene-di-β naphtospiropyran | | 0.40 parts by wt. |
| anisole | | 100 parts by wt. |
| threshold activation temperature | 75° C. | |

In photoactivation, the sensitizer in the emulsion is created upon short exposure to a radiation of appropriate wavelength. The choice of this wavelength is critical because it must not expose imagewise the unsensitized emulsion. The wavelength should therefore be located in a region of the spectrum which is outside the absorption of the unsensitized silver halide. An acceptable range for the wavelengths for activation has been found in the very short UV regions or in the visible range above 520 nm. The choice of a wavelength in the visible should also be guided by the emission spectrum of most common light sources including sunlight unless a filter is to be used for the exposure. FIG. 9 shows the emission spectrum of sunlight and FIG. 10 that of a Xenon lamp. Other light sources may emit in the region of the spectrum not occupied by the spectra shown in FIGS. 9 and 10. As it is difficult to know in advance the source which will be used for exposure, the use of a filter is preferred. The photography process should then encompass two phases: the activation of the film and the exposure through a pass band filter followed by conventional chemical processing. The activation and exposure can be carried out either simultaneously or separately.

Materials able to provide a sensitizer upon photoactivation are photochromes. A photochrome is a material normally white or transparent which becomes colored by exposure to a radiation of a given wavelength. Similar to the thermochromes, the conditions for sensitization of silver halide also depend on the ability of the colored species to satisfy one of the sensitizing mechanisms described above.

Photochromes can also generate merocyanines as the benzothiazol spiropyrans of the general formula:

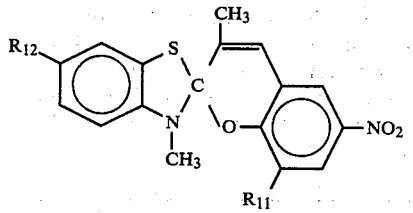

where $R_{11}$ and $R_{12}$ may be the same or different and are selected from the group consisting of S-alkyl and O-alkyl groups, the alkyl containing 1–4 carbons. For example,

| | |
|---|---|
| $R_{11} = OCH_3$ | $R_{12} = OCH_3$; |
| $R_{11} = SCH_3$ | $R_{12} = SCH_3$; |
| $R_{11} = OCH_3$ | $R_{12} = SCH_3$; and |
| $R_{11} = SCH_3$ | $R_{12} = OCH_3$ |

or indoline spiropyrans having the formula:

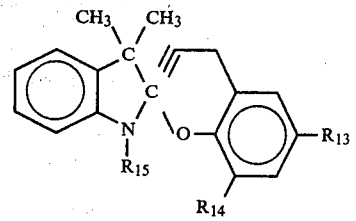

where $R_{13}=NO_2$, Cl, Br $R_{14}=OCH_3$, Cl, Br and $R_{15}=CH_3$, $C_6H_5$ or $C_3H_7$ Photosensitization can also be obtained with certain Schiff bases called anils with the general formula:

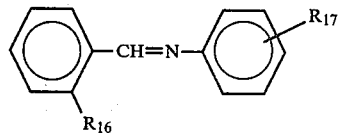

where $R_{16}$ is $—OCH_3$, $—OCH_2CH_3$, or $—OC_6H_5$ and $R_{17}$ is $—CH_3$, $—CH_2CH_3$, or $—C_6H_5$ or $R_{17}$ may combine with the benzene ring attached to the N atom to form a naphthalene group. A useful example of this kind of material is N-salycylidene-β-naphthylamine:

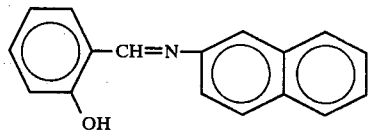

In temporary photoactivation, the exposition to the activation light takes place immediately before or simultaneously with imagewise exposure. This can be done by triggering a flash just before acting on the shutter in the first case or by synchronizing a flash with the shutter in the second case.

In FIG. 11, the film 801 is stored within camera body 803. One end of the film 801 is wound on take-up spool 805 whereas the other end is stored in supply spool 807. An activation lamp 809 is stored within the camera so that when lit its rays shine on film 801. Lamp 809 is set to become lit just before the shutter (not shown) is triggered. By such an arrangement, activation of the sensitization promoter by photo-energy is obtained.

Photoactivated sensitizers for color emulsions are in the class of photochromic dyes or photochromic reactions. The following compounds have been found to be useful examples of photoactivated sensitizers.

A. Red Sensitizers

The following compounds turn blue upon exposure to ultraviolet light and sensitize in the red part of the spectrum:

a. Trimethyl-1-3-3 indolaminonaphtospiropyran, PRa

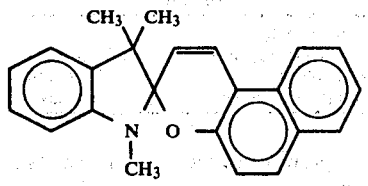

b. Phenoxymethyl-2-benzothiazolaminospiropyran, PRb:

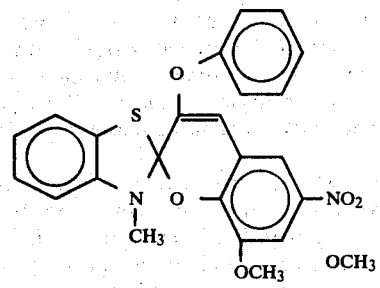

c. N-3-Pyridylsydnone, PRc:

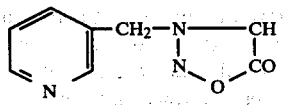

B. Green Sensitizer

The action of ultraviolet light on 2,4-dinitrobenzylic alcohol, PGa:

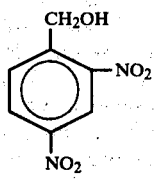

develops a red coloration and promotes a sensitizing action in the green.

C. Blue Sensitizer

Photosensitization in the blue is provided by tetrabenzoylethylene, PBa:

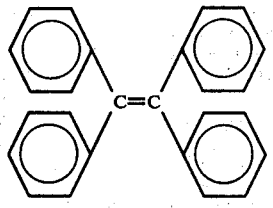

The present photosensitizer can be introduced into the basic emulsion as a solution according to the following compositions:

| | |
|---|---|
| Red sensitizer, PRa: | |
| Trimethyl-1-3-3 indolaminonaphto-spiropyran | 0.40 parts by wt. |
| Toluene | 50 parts by wt. |
| Acetone | 50 parts by wt. |
| Activation wavelength | 350 nm |
| Red sensitizer, PRb: | |
| Phenoxymethyl-2-benzothiazolamino-spiropyran | 0.50 parts by wt. |
| Ethyl alcohol | 100 parts by wt. |
| Activation wavelength | 320 nm |
| Red sensitizer, PRc: | |
| N—3-Pyridylsydone | 0.80 parts by wt. |
| Cyclohexane | 100 parts by wt. |
| Activation wavelength | 320 nm |
| Blue sensitizer, PBa: | |
| Tetrabenzoylethylene | 0.75 parts by wt. |
| Cyclohexane | 100 parts by wt. |
| Activation wavelength | 350 nm |
| Green sensitizer, PGa: | |
| 2,4 dinitrobenzylic alcohol | 0.80 parts by wt. |
| Cyclohexane | 100 parts by wt. |
| Activation wavelength | 305 nm |

The composition of each of the emulsion layers for photosensitized emulsions is similar to that shown for thermal activated emulsions. In addition, the length of photo-exposure to activate the emulsions varies with the material used. Generally, an exposure of about 2 to about 10 seconds will be sufficient.

In electroactivation, the sensitizer is activated by an electric field applied to the emulsion. Three types of actions can be used:

a. Field effect: no current
b. Electrolytic process: ionic current
c. Electronic process: electron current In each case, the application of the electric field results in a coloration of the medium and a sensitization corresponding to the color created.

The first type of action is due to dipolar properties of the molecules involving a reorganization of the electronic structure, similar to an isomerization. A typical example of a compound which can be so activated is Indophenol blue.

The second type of action is electrolytic and involves a reduction or an oxidation of a compound due to ionic displacement. As examples of compounds which can be used in such an activation process viologens can be mentioned.

The third type of action is electronic and involves the displacement of electrons to, for example, fill traps in a defect material resulting in the formation of color centers. Materials which can undergo such an activation include sydnones.

The activation field is applied perpendicularly to the emulsion in a capacitor like structure. In alternative (a) the electrodes do not need to be in physical contact with the emulsion but for (b) and (c) a good contact is necessary.

Similar to the other modes of activation (photo and thermal), this activation can be temporary or permanent.

In temporary electroactivation one of the electrodes has to be transparent to allow exposure therethrough. The electrode is made of a transparent conductive glass (NESA) and placed in the camera itself, as represented on FIG. 12.

In FIG. 12, the photography film 901 in the form of a strip is disposed within the camera body 903. One end of the film is wound on take-up spool 905 whereas the other end is stored in supply spool 907. The film is interposed between black electrode 909 and front electrode 911. The front electrode is connected via front contact 913 to one terminal of a battery 915 and the back electrode is connected via back contact 917 to the other terminal of the battery. A switch 919 is provided in the circuitry for the battery and electrodes to activate and deactivate the electrodes. Prior to an imagewise exposure, the film is sensitized by closing switch 919 for an appropriate period of time. The film is then exposed and developed to form a positive or negative photograph.

Electroactivated sensitizers for color emulsions are in the class of electrochromic dyes or electrochromic reactions.

Among the above-listed electro-activation processes, the electrolytic (ionic current) process is preferred. In the electrolytic process, the following compounds have been found to be particularly preferred as useful sensitization promoters:

A. Red Sensitizer

Benzylviologen, ERa:

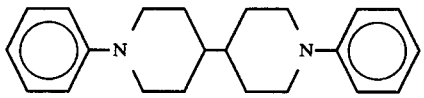

The red sensitizer turns blue upon the application of a two-volt potential on the electrodes and promotes sensitization in the red.

B. Green Sensitizer

Green sensitization is obtained electrolytically through the oxidation of methoxyaminopyridine, EGa:

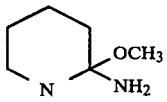

C. Blue Sensitizer

The electrolytic oxidation of hydroxyamino pyridine, EBa:

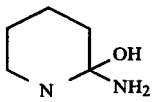

provides a blue sensitizer.

The sensitization promoters listed above are dissolved in solvents in the proportions set out below. The solution is then added to the emulsions noted above to form a color photography element which can be sensitized by electro-energy.

| | |
|---|---|
| Red sensitizer, ERa: | |
| Benzylviologen | 1.50 parts by wt. |
| Ethyl alcohol | 50 parts by wt. |
| Water | 50 parts by wt. |
| Sensitization potential | 2 volts |
| Green sensitizer, EGa: | |
| Methoxyaminopyridine | 0.80 parts by wt. |
| Ethyl alcohol | 100 parts by wt. |
| Sensitization potential | 4 volts |

-continued

| | |
|---|---|
| Blue sensitizer, EBa: | |
| Hydroxyaminopyridine | 0.80 parts by wt. |
| Ethyl alcohol | 100 parts by wt. |
| Sensitization potential | 6 volts |

The photographic element after having been activated to convert the sensitization promoters into sensitizers is then exposed to record an image in the film. The so-exposed film is then subjected to a conventional developing process to form a color photograph film.

The color photography element discussed above may be either a positive or a negative film. For positive films, the couplers are so chosen that complementary colors are formed, viz. yellow for blue, magenta for green and cyan for red. For negative films, the couplers have colors matching the fundamental colors of red, blue and green.

Couplers which can be used in connection with the present invention are well known in the art. Preferably, the couplers are capable of coupling with the oxidation product of primary aromatic amino developing agents, although it is possible to use other developing agents. The couplers are selected with regard to the color of dye which is formed. The identity of specific couplers used is not critical. That is to say, any coupler which forms dyes of the proper color can be used in the photographic element of the present invention.

The support or substrate layer for the present photography element may be transparent or opaque. When the element is a photography film, the support comprises a layer of a light transmitting material such as polyesters, cellulose triacetate and cellulose butyrate. If the element is a photography paper, the support comprises paper.

Silver halide compounds which can be used in the present invention include silver iodide, silver bromide, and silver bromoiodide. Among these, silver bromide is preferred since it does not absorb in the blue portion of the spectrum as does silver iodide.

The amounts of silver halide and coupler in each of the emulsion layers are well known in the art. The following represents a general formula useful in preparing the present color photography emulsions:

| | | |
|---|---|---|
| A. Upper layer (furthest from support and sensitized for blue) | | |
| | Silver halide emulsion | 1 Kg |
| | Sensitization promoter | 30 ml |
| | Coupler | 500 ml |
| | Stabilizer (sol 1%) | 30 ml |
| | Emulsifier (sol 4%) | 5 ml |
| | Thickness of layer | 6.5 microns |
| B. Middle layer (sensitized for green) | | |
| a. | Silver halide emulsion | 1 Kg |
| | Sensitization promoter | 35 ml |
| | Coupler | 200 ml |
| b. | Stabilizer (sol 1%) | 30 ml |
| | Pyrocatechol (sol 1%) | 6 ml |
| | Emulsifier (sol 4%) | 5 ml |
| | Thickness of layer | 4 microns |
| C. Bottom layer (next to support and sensitized for red) | | |
| | Silver halide emulsion | 1 Kg |
| | Sensitization promoter | 30 ml |
| | Coupler | 330 ml |
| | Stabilizer (Sol 1%) | 30 ml |
| | Pyrocatechol (Sol 1%) | 6 ml |
| | Emulsifier (Sol 4%) | 10 ml |
| | Thickness of layer | 9 microns |

The different layers with intermediate layers are coated on the support by methods well known in the art, e.g., a meyer rod.

As has been mentioned, the color photography element of the present invention can be exposed to moderate level of light, such as room light, without causing the formation of color images thereon. This results from the fact that the present emulsions are not sensitized to absorb color light. This is particularly true when silver bromide is used as the silver halide in the emulsion since the absorption band for silver bromide (300 to 500 nm) is outside the wavelength range for color light, 500 to 700 nm. However, since silver iodide is naturally sensitized to blue light (500 nm), the exposure of the present emulsion containing silver iodide as the silver halide should be avoided. This does not mean that silver iodide should not be used in the present invention. This only means that when it is desired that the photography element be insensitive to room light, silver bromide should be used as the silver halide. In the event that insensitivity to light is not critical, silver iodide can be used as the silver halide.

Since, in the present invention, the sensitizer is formed in situ prior to exposure, this provides fresh ingredients in the photography element which constitutes another advantage of the present invention.

The present invention provides a color photography element which can be exposed and processed by methods well known in the art. Although an activation means is included in the cameras shown above, it does not mean that the present invention must be so restricted. For example, the element may be permanently activated by the manufacturer or prior to sale to the user. However, it is preferred to activate the emulsions in situ prior to the exposure of the element since this provides a freshly activated photography element.

EXAMPLES

The present invention is further illustrated in the following non-limiting examples.

Figure 1:
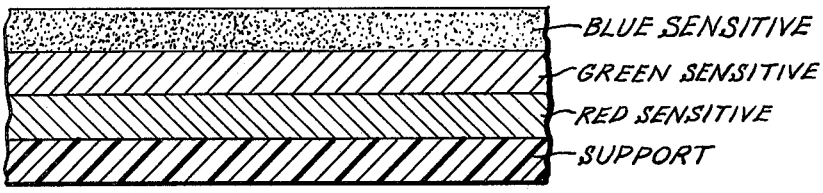
FIG. 1 shows a cross-sectional view of a color photography element.
Figure 2:
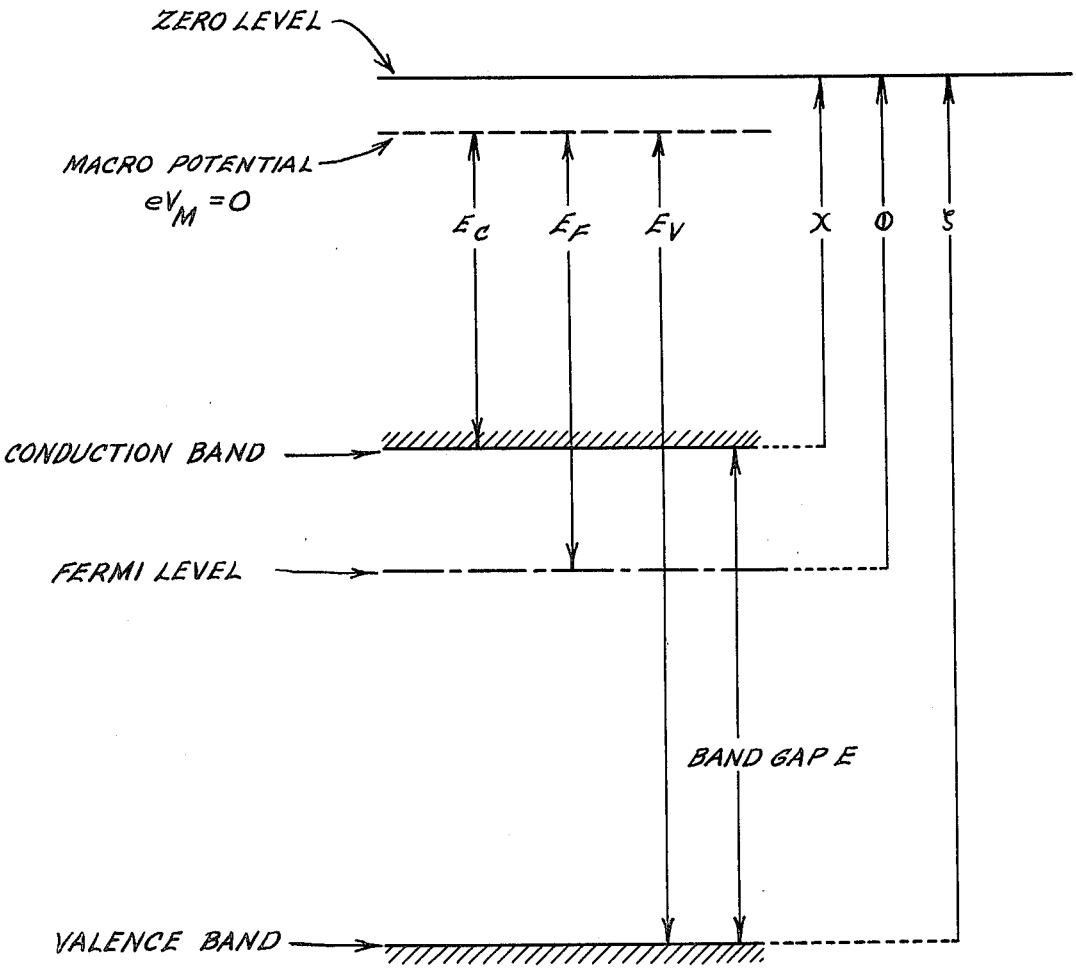
FIG. 2 illustrates the energy levels necessary for dye sensitization.
Figure 3:
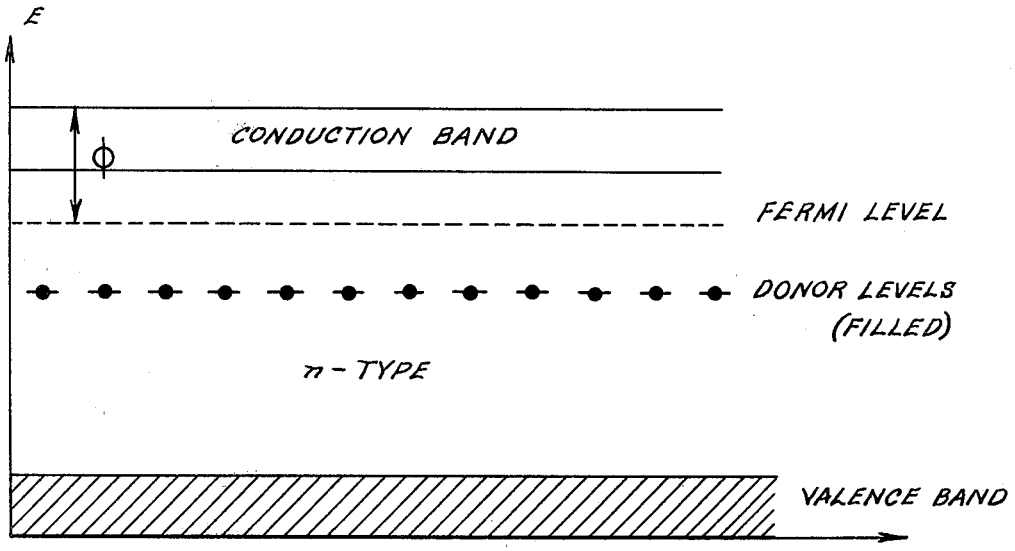
FIGS. 3 and 4 show the energy level for n and p types semiconductors, respectively.
Figure 4:
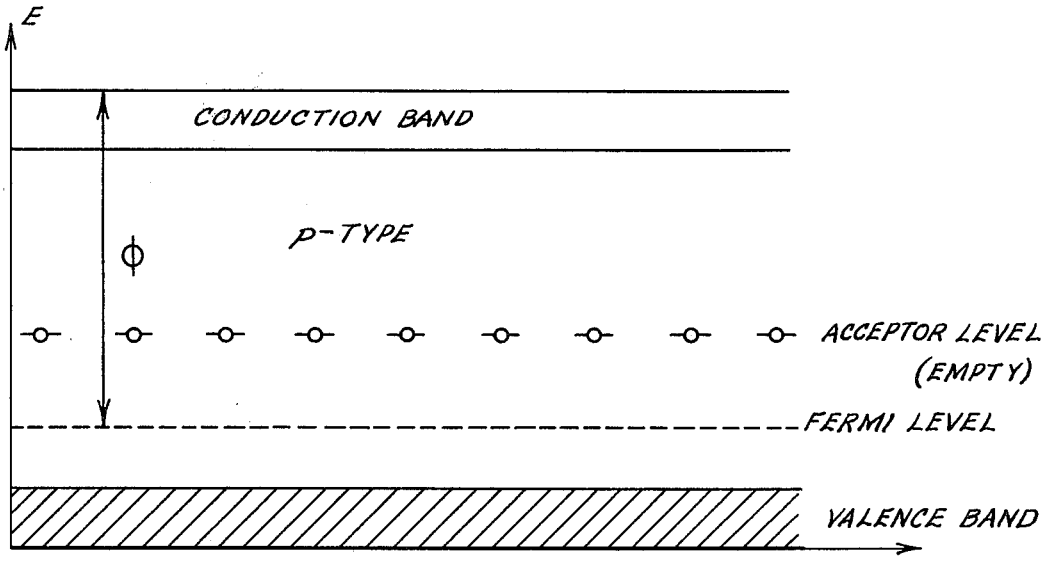
Figure 5:
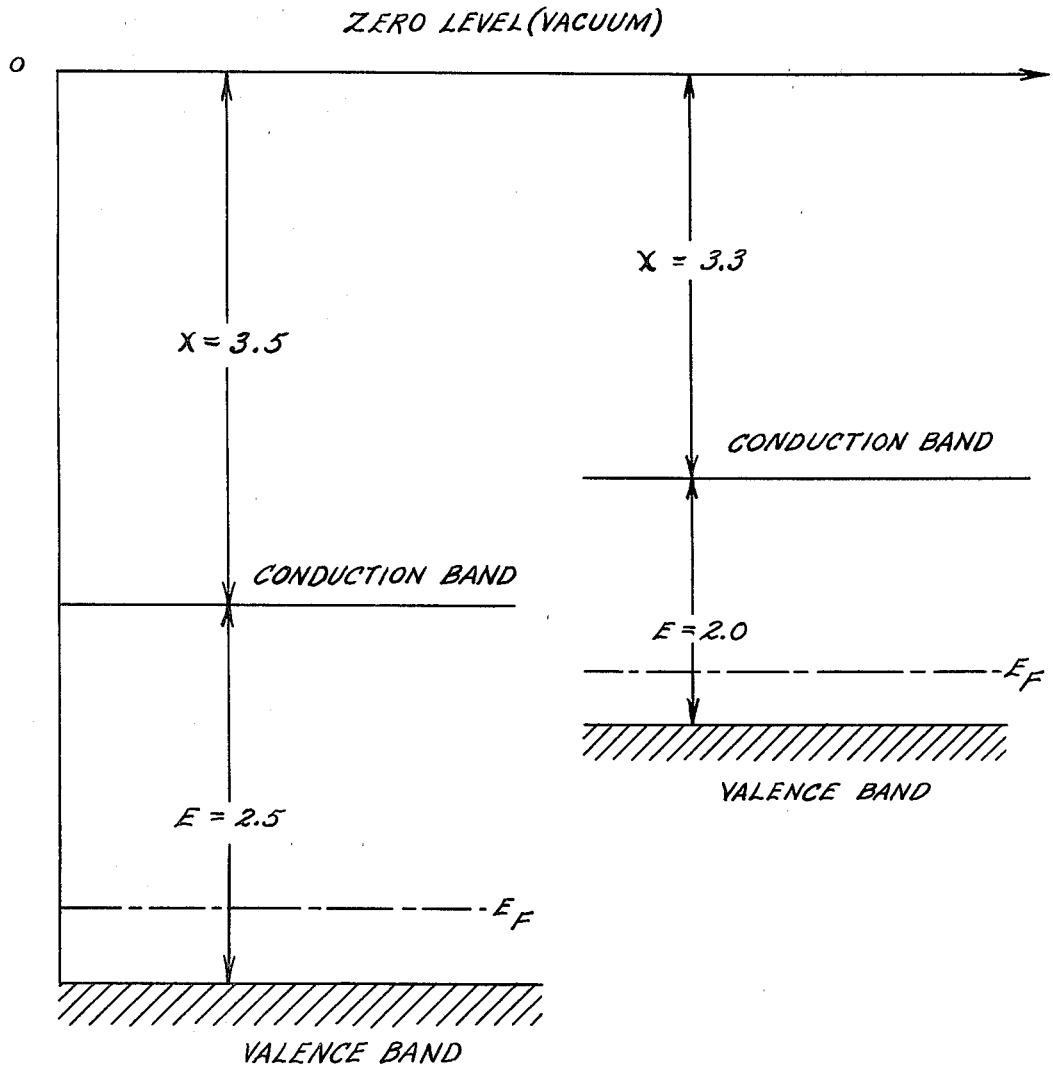
FIG. 5 illustrates the relative position of electronic energy levels in various dyes and silver bromide.
Figure 6A:
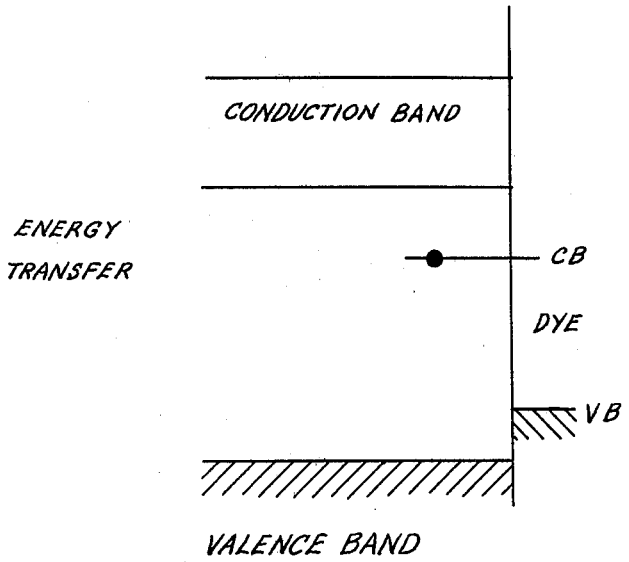
Figure 6B:
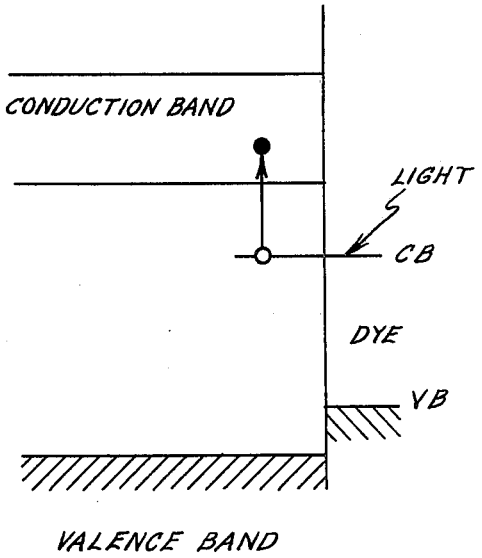
Figure 6C:
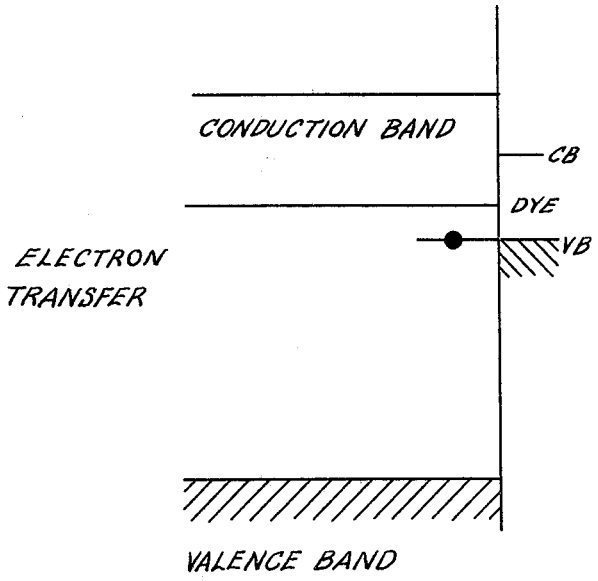
Figure 6D:
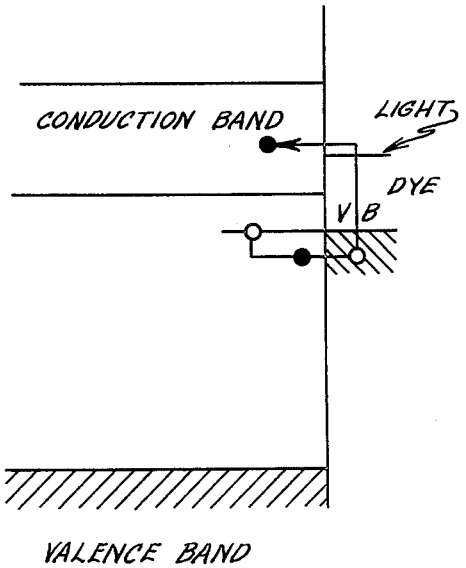

Various color photography elements are formed in accordance with the configuration shown in FIG. 1. The support comprises cellulose triacetate.

The blue sensitive layer has the following composition:

| | |
|---|---|
| Emulsion comprising silver bromide and gelatin | 1 kg |
| Sensitization promoter | (varied) ml |
| Coupler for yellow | 500 ml |
| Stabilizer (1% solution) | 30 ml |
| Nekal BX* (4% solution) | 5 ml |
| Thickness of the layer | 6.5 microns |

*A product of Union Carbide.

The coupler is aminoisophthalic acid-stearoanilidebenzoylacetanilide and is introduced in an alkaline solution containing 4.5 g of the coupler, 16.2 ml 1 N NaoH solution and 150 ml water, the pH of the solution being 10.1.

The green sensitive layer has the following composition:

| | |
|---|---|
| Emulsion comprising silver bromide and gelatin | 1 kg |
| Sensitization promoter | (varied) ml |
| Coupler for magenta | 200 ml |
| Stabilizer (1% solution) | 30 ml |

-continued

| | |
|---|---|
| Pyrocatechol (1% solution) | 6 ml |
| Dismulgan T* (4% solution) | 5 ml |
| Thickness of the layer | 4 microns |

*Product of Huls Chemischewerke.

The coupler is diphenyl-1-sulfonic-ether-3-stearylpyrazolone and is introduced in an alkaline solution containing 7.5 g of the coupler, 20 ml of 1 N NaoH solution and 150 ml of water, the pH of the solution being 9.

The red sensitive layer has the following composition:

| | |
|---|---|
| Emulsion comprising silver bromide and gelatin | 1 kg |
| Sensitization promoter | (varied) ml |
| Coupler for cyan | 330 ml |
| Stabilizer (1% solution) | 30 ml |
| Pyrocatechol (1% solution) | 6 ml |
| Igepal C* (4% solution) | 10 ml |
| Thickness of the layer | 9 microns |

*A product of American Cyanamid Company.

The coupler is methylstearyldiamine-γ-hydroxynaphtoylanilide and is introduced in an alkaline solution containing 15 g of the coupler, 9.45 g of NaOH, 150 ml water and 4.5 ml methanol, the solution having a pH of 9.8.

Thermally Activated Sensitizer

EXAMPLE 1

The emulsion layers described above are prepared using 30 ml of di-β-naphtospiropyran (SRa) introduced as a solution containing 0.4 g of the compound in 100 g anisole, as the promoter in the red sensitive layer, 30 ml of phenylene-di-benzospiropyran (SGa) introduced as a solution containing 0.70 g of the compound in 100 g of anisole as the promoter in the green sensitive layer; and 30 ml of 3,3′ trimethylene-di-β-naphtospiropyran (SBa) as a solution containing 0.4 g of the compound in 100 g of anisole as the promoter in the blue sensitive layer.

The so-formed color photography element is heated to a temperature of 60° C. for 10 seconds by means of an infrared lamp to activate the promoters. The exposed and developed photography element which is developed using conventional processing techniques shows color images comparable to those obtained in conventional film.

EXAMPLE 2

Example 1 is repeated with the exception that 30 ml of xantho-β-naphtospiropyran (SRb), introduced as a solution containing 0.30 g of the above compound in 100 g of anisole is used in the red sensitive layer as the promoter. The so-formed element is heated to a temperature of 60° C. for 5 seconds by means of an infrared lamp to activate the promoters.

EXAMPLE 3

Example 1 is repeated with the exception that 20 ml of dimethyl 2,6-γ-pyrylium oxide (SGb) introduced as a solution containing 0.80 g of the compound in 100 gm of ethyl alcohol is used in the green sensitive layer as the promoter. The so-formed element is heated to a temperature of 48° C. for 10 seconds by means of an infrared lamp to activate the promoters.

EXAMPLE 4

Example 2 is repeated with the exception that 30 ml of dimethyl 2,6-γ-pyrylium oxide (SGb) introduced as a solution containing 0.80 g of the compound in 100 gm of ethyl alcohol is used in the green sensitive layer as the promoter. The so-formed element is heated to a temperature of 48° C. for 10 seconds by means of an infrared lamp to activate the promoters.

Photo-activated Emulsions

EXAMPLE 5

The above emulsions are prepared using the following as sensitization promoters. In the blue sensitize layer, tetrabenzoyl-ethylene (PBa) is used as the promoter. This compound is introduced as a solution containing 0.75 g of the compound in 100 g of cyclohexane. 30 ml of the promoter solution is used in the blue sensitive layer.

In the green sensitive layer, 30 ml of 2,4 dinitrobenzylic alcohol (PGa) introduced as a solution containing 0.80 gm of the compound in 100 g of cyclohexane is used as the promoter.

In the red sensitive layer, 30 ml of trimethyl-1-3-3 indolaminonaphtospiropyran (PRa) introduced as a solution containing 0.40 gm of the compound in 50 gm of toluene and 50 gm of acetone is used as the promoter.

The so-formed emulsions are used to provide a color photography element. The promoters are activated by subjecting the element to UV light for a period of 5 seconds. Thereafter, the element is exposed imagewise and developed in accordance with conventional processing techniques. The resulting color photography element shows colors comparable to those in conventional photography elements.

EXAMPLE 6

Example 5 is repeated except that phenoxymethyl-2-benzothiazolamino-spiropyran (PRb) is used as the promoter in the red sensitive layer. The promoter is introduced as a solution containing 0.50 gm of the compound in 100 gm of ethyl alcohol. The amount of the promoter solution used is 30 ml. The so-formed photographic element is subjected to UV light radiation for a period of 2 seconds to activate the promoters.

EXAMPLE 7

Example 5 is repeated except that 30 ml of a solution containing 0.80 gm of N-3-pyridylsydnone (PRc) in 100 gm of cyclohexane is used as the promoter in the red sensitive layer. The so-prepared photography element is subjected to UV light for 2 seconds to activate the promoters.

Electro-activated Emulsions

EXAMPLE 8

The above emulsions are prepared using the following as sensitization promoters. In the red-sensitive layer, 30 ml of a solution containing 1.50 gm benzylviologen (ERa), 50 gm ethyl alcohol and 50 gm water is used as the promoter.

In the green sensitive layer, 40 ml of a solution containing 0.80 gm of methoxyaminopyridine (EGa), and 100 gm of ethyl alcohol is used as the promoter.

In the blue sensitive layer, 30 ml of a solution containing 0.80 gm of hydroxyaminopyridine (EBa) and 100 gm of ethyl alcohol is used as the promoter.

The emulsions so prepared are used to form a color photography element. The element is subjected to an electropotential of 4 volts for 3 seconds at a current of $10^{-3}$ amps to activate the promoters. Immediately thereafter, the element is exposed imagewise and developed using conventional processing techniques. The so-obtained photography element shows colors comparable to conventional emulsions.

What is claimed is:

1. A color photography element comprising a support and a plurality of emulsion layers arranged one on top of the other, each of the emulsion layers comprising a silver halide, a color-forming coupler material capable of forming a color dye upon reacting with an oxidized organic amino color developer, and a sensitization promoter material which is capable of being converted into a sensitizer material for the silver halide to permit absorption of light rays in a part of the spectrum upon the application of an activation energy comprising electroenergy which is selected from the group consisting of an electric field, an ionic current and an electron current.

2. A color photography element comprising a support and a plurality of emulsions layers arranged one on top of the other each of the emulsion layers comprising a silver halide, a color-forming coupler material capable of forming a color dye upon reacting with an oxidized organic amino color developer, and a sensitization promoter material which is capable of being converted into a sensitizer material for the silver halide to permit absorption of light rays in a part of the spectrum upon the application of an activation energy comprising thermal energy, the promoter being selected from the group consisting of: benzothiazol spiropyrans having the general formula,

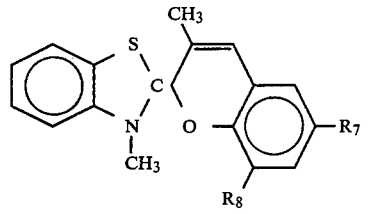

wherein $R_7$ and $R_8$ are halogens; polymethine dyes having the formula

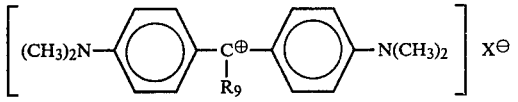

where $X^{\ominus}$ is an anion and $R_9$ is selected from the group consisting of

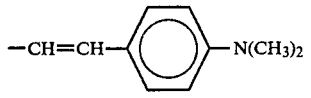

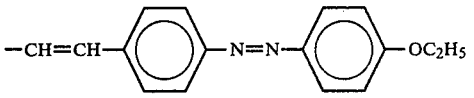

-continued

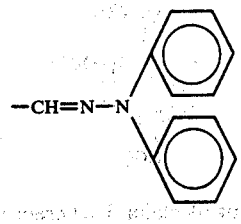

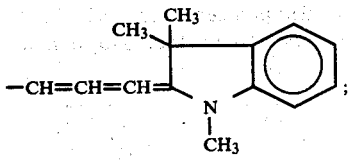

and pyrylium oxides having the formula

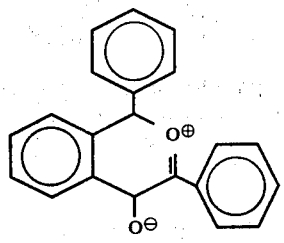

3. A color photography element comprising a support and a plurality of emulsion layers arranged one on top of the other, each of the emulsion layers comprising a silver halide, a color-forming coupler material capable of forming a color dye upon reacting with an oxidized organic amino color developer, and a sensitization promoter material which is capable of being converted into a sensitizer material for the silver halide to permit absorption of light rays in a part of the spectrum upon the application of an activation energy comprising light having a wavelength of from 200 to 500 nanometers, the promoter being selected from the group consisting of benzothizol spiropyrans having the formula

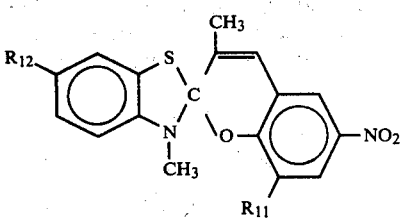

wherein $R_{11}$ and $R_{12}$ may be the same or different and are selected from the group consisting of O-alkyl and S-alkyl, the alkyl containing 1–3 carbons; indoline spiropyrans having the formula

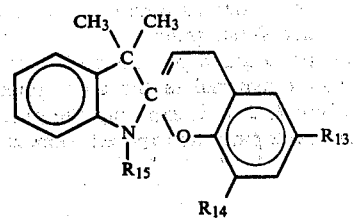

wherein $R_{13}$ is $NO_2$, Cl or Br $R_{14}$ is O-alkyl, Cl or Br, and $R_{15}$ is anil having the formula

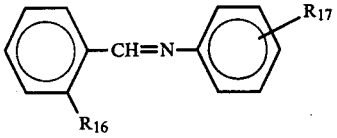

wherein $R_{16}$ is O-alkyl, the alkyl having 1–3 carbons, and $R_{17}$ is alkyl having 1–3 carbons, aryl, or $R_{17}$ may be combined with the benzene ring attached to the N atom to form a naphthalene group.

4. The photographic element of claim 1, 2 or 3 wherein the silver halide is selected from the group consisting of silver bromide, silver iodide, and silver bromoiodide.

5. The element of claim 2 wherein upon activation the promoter forms a sensitizer for the red part of the spectrum and is selected from the group consisting of di-$\beta$ naphtospiropyran having the formula

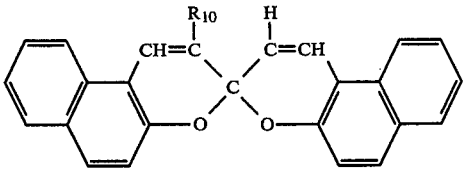

where $R_{10}$ is $CH_3$ or H, and xantho-$\beta$-naphtospiropyran having the formula

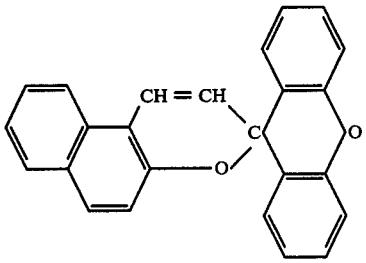

6. The element of claim 2 wherein upon activation the promoter forms a sensitizer for the green part of the spectrum and is selected from the group consisting of: phenylene-di-benzospiropyran having the formula

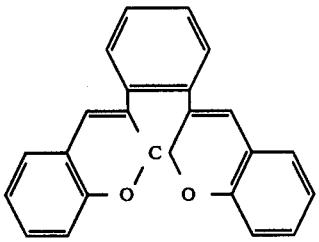

dimethyl 2,6$\gamma$ pyrylium oxide having the formula

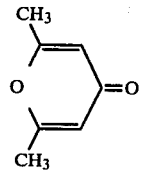

7. The element of claim 2 wherein upon activation the promoter forms a sensitizer for the blue part of the spectrum and comprises 3,3' trimethylene-di-β-naphtospiropyran having the formula:

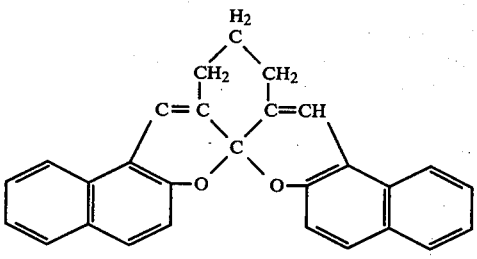

8. The element of claim 3 wherein upon activation the promoter forms a sensitizer for the red part of the spectrum and is selected from the group consisting of: trimethyl-1-3-3 indolaminonaphtospiropyran

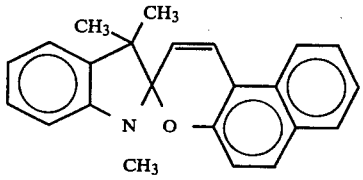

phenoxymethyl-2-benzothiazolaminospiropyran having the formula

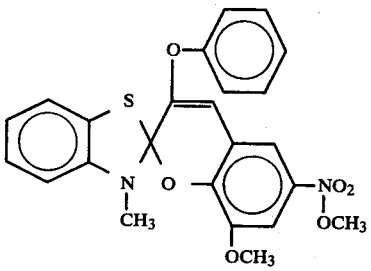

N-3-pyridylsydnone having the formula

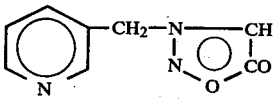

9. The element of claim 3 wherein the promoter upon activation forms a sensitizer for the green part of the spectrum and comprises 2,4 dinitrobenzylic alcohol having the formula

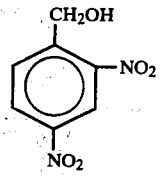

10. The element of claim 3 wherein upon activation the promoter forms a sensitzer in the blue part of the spectrum and comprises tetrabenzoylethylene

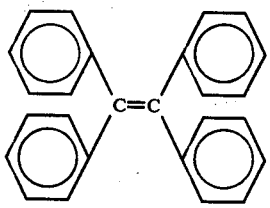

11. The element of claim 1 wherein the promoter is activated by an ionic current to form a sensitizer in the red part of the spectrum and comprises benzylviologen having the formula

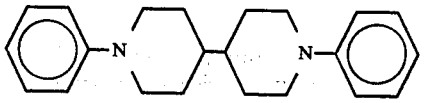

12. The element of claim 1 wherein the promoter is activated by an ionic current to form a sensitizer in the green part of the spectrum and comprises methoxyaminopyridine having the formula

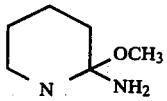

13. The element of claim 1 wherein the promoter is activated by an ionic current to form a sensitizer in the blue part of the spectrum and comprises hydroxyamino pyridine

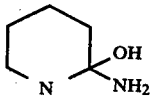

14. The photography element of claim 1, 2 or 3 wherein the element forms a positive color photograph after exposure and developing.

15. The photography element of claim 1, 2 or 3 wherein the element forms a negative color photograph after exposure and developing.

16. A color photograph process comprising activating the promoter material in the color photographic element of claim 1, 2 or 3; exposing the photographic element; and developing the exposed element.

* * * * *